United States Patent [19]

Hansson

[11] Patent Number: 4,842,078

[45] Date of Patent: Jun. 27, 1989

[54] SCREW JOINT TIGHTENING POWER TOOL

[75] Inventor: Gunnar C. Hansson, Stockholm, Sweden

[73] Assignee: Atlas Copco Aktiebolag, Nacka, Sweden

[21] Appl. No.: 268,637

[22] Filed: Nov. 7, 1988

Related U.S. Application Data

[63] Continuation of Ser. No. 56,788, May 29, 1987, abandoned.

[30] Foreign Application Priority Data

Jun. 6, 1986 [SE] Sweden ..... 86025673

[51] Int. Cl.[4] ..... B25B 23/14

[52] U.S. Cl. ..... 173/12; 192/150

[58] Field of Search ..... 173/12; 192/56 R, 150; 81/467, 469, 473

[56] References Cited

U.S. PATENT DOCUMENTS

| | | | |
|---|---|---|---|
| 3,608,686 | 9/1971 | Martin, Sr. et al. | 192/150 |
| 3,834,467 | 9/1974 | Fuchs | 173/12 |
| 4,049,104 | 9/1977 | Webb | 173/12 |
| 4,215,594 | 8/1980 | Workman, Jr. et al. | 173/12 X |

FOREIGN PATENT DOCUMENTS

| | | | |
|---|---|---|---|
| 2064682 | 6/1981 | United Kingdom | 192/56 R |

*Primary Examiner*—Frank T. Yost
*Assistant Examiner*—James L. Wolfe
*Attorney, Agent, or Firm*—Frishauf, Holtz, Goodman & Woodward

[57] ABSTRACT

A screw joint tightening power tool including a torque limiting device and a rotation motor which via a planetary reduction gear (13) is arranged to deliver a torque to an output spindle (14). A torque responsive release clutch (22, 26, 27) is associated with the planetary gear (13) in order to maximize the output torque of the tool. The ring gear (20) of the planetary reduction gear (13) is rotatably as well as axially movable in the housing (10) and forms together with the housing (10) a torque responsive release clutch which is arranged to transfer a reaction torque from the planetary gear (13) to the housing up to a level determined by the axial bias force provided by a spring (28) acting on the ring gear (20). The release clutch comprises a cam (22, 26) for axially displacing the ring gear (20) against the action of said spring (28) upon rotation of the ring gear (20) relative to said housing (10) as a certain reaction torque level is exceeded. A sensor (33) is coupled to the ring gear (20) to detect axial displacement of the latter and cause deactivation of the power supply of the motor.

2 Claims, 1 Drawing Sheet

SCREW JOINT TIGHTENING POWER TOOL

This application is a continuation of application Ser. No. 056,788, filed May 29, 1987, now abandoned.

BACKGROUND OF THE INVENTION

This invention relates to a screw joint tightening power tool with a torque limiting means. In particular the invention concerns a power tool comprising a housing, a rotation rotor mounted in said housing, an output spindle connectable to a screw joint engaging means, at least one planetary reduction gear including a ring rear which is rotatively supported in said housing, and a torque responsive release clutch associated with said planetary gear and arranged to maximize the output torque delivered by said output spindle.

A power tool of the above type is previously described in U.S. Pat. No. 3,834,467. This known tool is rather complicated in construction since it incorporates two cam following rollers which are journalled on the ring gear of the planetary gearing as well as an axially displaceable cam member which is coupled to a motor shut off means in the form of a bellows operated air supply valve. Since the two cam following rollers are journalled on the ring gear and rotate with the latter, the angular distance during which the motor and other rotating parts of the tool are to be stopped at motor shut off cannot exceed half a revolution. Often that is too short a distance to avoid a further overriding of the cams and causing of a torque adding impulse in the output spindle.

The invention intends to solve the above problems by incorporating into the power tool the characterizing features stated in the claims.

DETAILED DESCRIPTION

Figure 1:
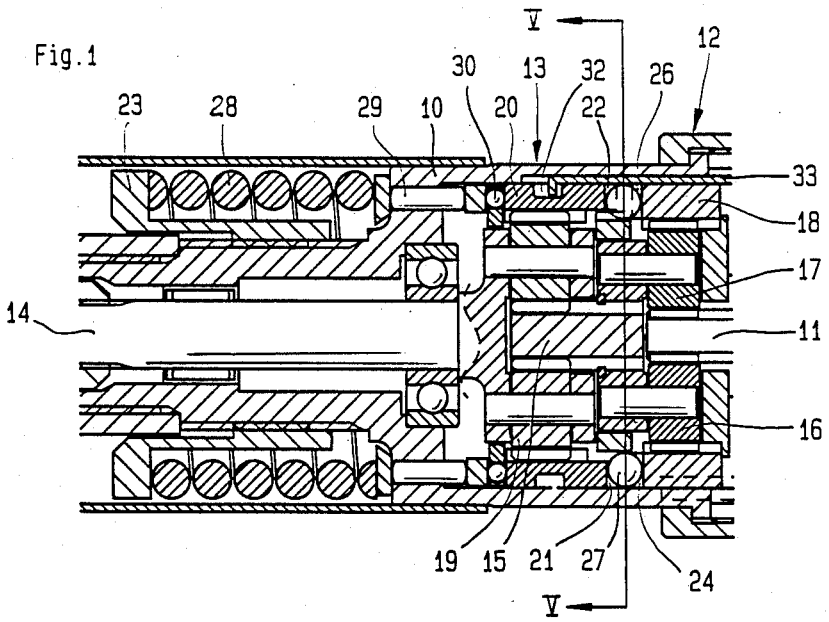
FIG. 1 shows a longitudinal section through the power transmission and torque limiting means of a power tool according to the invention.

The power tool illustrated in the drawing figures comprises a housing 10 in which is mounted a rotation motor (not shown) which by a drive shaft 11 delivers a torque to a power transmission which includes two planetary reduction gears 12 and 13. The latter is coupled to an output shaft 14 which is connectable to a screw joint engaging means, such as a nut socket.

The first planetary gear 12 comprises a planet carrier 16, a number of planet wheels 17 and a ring gear 18 immovably mounted in the housing 10. The planet carrier 16 comprises a sun gear 15 for cooperation with the planet wheels 19 of the second planet gear 13. The planet wheels 19 are supported by a planet carrier which is formed in one piece with the output spindle 14. The second planet gear 13 also comprises a ring gear 20 which is rotatably supported in the housing 10 as well as axially displaceable relative thereto. At its right hand end the ring gear 20 is formed with a flat annular end surface 21 which is broken by two axially extending teeth 22 which are formed with inclined cam surfaces. See FIGS. 2–4. The immovable ring gear 18 of the first planetary gear 12 has on its left hand end a flat annular end surface 24 which is broken by two axially extending teeth 26 which, similarly to the teeth 22 on the movable ring gear 20, are provided with inclined cam surfaces. Between the two ring gears 20 and 18 there are employed two balls 27 which together with the flat surfaces 21 and 24 form an axial thrust bearing between the two ring gears. The ring gear 20 is biased toward ring gear 18 by means of a spring 28 which via axially extending pins 29 and an axial thrust bearing 30 exerts an axial bias force on the ring gear 20. The spring 28 is supported by a flanged nut 23 which is adjustably connected to the housing 10.

The ring gear 20 is formed with an outer circumferential groove 32 which is arranged to be engaged by a sensing element 33 which in turn is connected to the power supply means of the motor (not shown).

Figure 2:
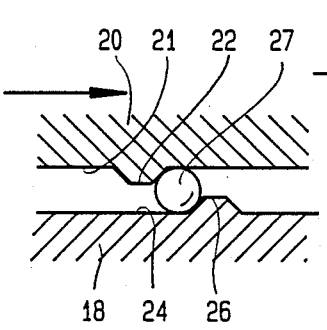
FIGS. 2–4 show a detail of the torque responsive release clutch during the torque transmitting, overriding and free running sequences.
Figure 3:
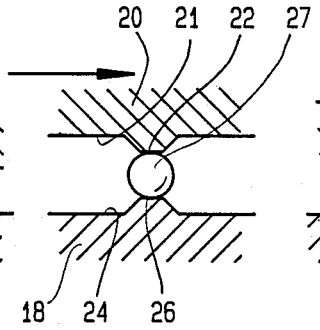

In operation, a torque supplied by the motor shaft 11 is transmitted via the planetary gearings 12 and 13 to the output spindle 14 and further to a screw joint to be tightened. As the torque passes through the second planetary reduction gear 13 a reaction torque is transferred to the ring gear 20. The latter is prevented from being rotated by interengagement of its teeth 22, the balls 27 and the teeth 26 of the stationary ring gear 18. Due to the inclined cam surfaces of the teeth 22 and 26 the ring gear 20 tends to move axially as a result of the transferred torque, but the axial bias force provided by the spring 28 keeps the ring gear 20 in its torque transferring position as illustrated in FIG. 2. When, however, the reaction torque reaches a certain level the axial force developed on the ring gear 20 will exceed the axial bias force provided by the spring 28 and cause an axial movement of the ring gear 20. Thereby, the teeth 22 of the ring gear 20 will override the teeth 26 of the stationary ring gear 18, the balls 27 continously acting as a roller bearing between the two ring gears 20, 18. During this overriding sequence, which is illustrated in FIG. 3, the ring gear 20 is axially displaced away from the stationary ring gear 18 and causes a motion of the sensing element 33 which will influence upon the power supply means of the rotation motor to, thereby, interrupt the power supply to the latter. This axial displacement of the ring gear 20 takes place during a very short period of time though, because as soon as the teeth 22 and 26 have passed each other the ring gear 20 regains its original axial position supporting against the stationary ring gear 18 by means of the balls 27.

Figure 4:
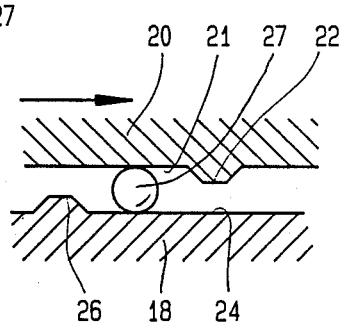
Figure 5:
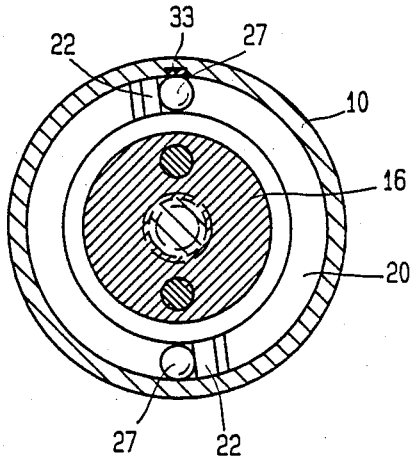
FIG. 5 shows a cross section along line V—V in FIG. 1.

After this overriding release sequence, there is a free running sequence, which is illustrated in FIG. 4. During this sequence the balls 27 will travel at half the speed of the ring gear 20 as a result of its contact with the flat end surface 21 of the latter and the flat surface 24 of ring gear 18. Since each of the teeth 26 and 22 have an axial extent which is less than half the diameter of the balls 27 they will not engage each other unless the balls 27 are located therebetween. See FIG. 2. This means that after the overriding sequence, the ring gear 20 will continue to rotate until the balls 27 are captured between the next pair of teeth 22 and 26. Since there are two balls and two teeth 22 on the ring gear 20 and two diametrically opposed teeth 26 on the stationary ring gear 18 there will be another engagement of the two ring gears 20 and 18 after a full revolution. This means in turn that after the release due to too a high reaction torque on the ring gear 20, the latter is able to rotate for 360° before its next engagement with the stationary ring gear 18. This means that there would be an angular distance of 360° for the rotating parts of the tool to come to a standstill after the clutch has been released, and that a second torque impulse due to reengagement of the clutch is safely avoided.

I claim:

1. A screw joint tightening power tool with a torque limiting means, comprising:

a housing (10);

a rotation motor mounted in said housing (10);

an output spindle (14) connectable to a screw joint engaging means;

at least one planetary reduction gear (13) including a ring gear (20) which is rotatably supported in said housing (10);

a torque responsive release clutch means (22, 26, 27) formed between said ring gear (20) and said housing (10) for transferring a reaction torque from said planetary reduction gear (13) to said housing (10), said clutch means having a rotation axis;

spring means (28) for exerting an axial bias force on said ring gear (20);

said ring gear (20) comprising a substantially flat annular surface (21) which extends transversely to said rotation axis of said clutch means and which surface is broken by at least two axially directed teeth (22) with inclined cam surfaces;

said housing (10) comprising a substantially flat annular transverse surface (24) extending in parallel with and facing said annular surface (21) of said ring gear (20), said annular surface (24) of said housing (10) being broken by at least two axially directed teeth (26) with inclined cam surfaces; and at least two rolling elements (27) located between said substantially flat annular surface (21) of said ring gear (20) and said substantially flat annular surface (24) of said housing (10) and forming an axial roller bearing between said substantially flat annular surfaces of said ring gear (20) and said housing (10), said at least two rolling elements (27) and said at least two teeth (22, 26) of said ring gear (20) and of said housing (10) forming together a cam means for coupling said ring gear (20) to said housing (10) and for interrupting said coupling when a predetermined reaction torque level between said ring gear (20) and said housing (10) is exceeded, said axial rolling bearing providing for a free running movement of said ring gear (20) relative to said housing (10) after each interruption of said coupling, said free running movement being considerably longer due to the rolling action of said rolling elements (27) than the angular distance between two subsequent teeth on each of said ring gear (20) and said housing (10).

2. The power tool of claim 1, further comprising:

power supply means connected to said rotation motor for supplying power to said rotation motor; and sensing means (33) for detecting axial displacement of said ring gear (20) and for initiating interruption of the power supply to said rotation motor by deactivating said power supply means.

* * * * *

UNITED STATES PATENT AND TRADEMARK OFFICE

CERTIFICATE OF CORRECTION

PATENT NO. : 4,842,078

DATED : June 27, 1989

INVENTOR(S) : Gunnar C. HANSSON

It is certified that error appears in the above-identified patent and that said Letters Patent is hereby corrected as shown below:

In column 4, Claim 1, line 18, after "gear (20)", insert

--through an angular distance--;

line 20, replace "free running movement" with

--angular distance--;

line 21, replace "longer" with --greater--.

Signed and Sealed this

Thirty-first Day of December, 1991

*Attest:*

HARRY F. MANBECK, JR.

*Attesting Officer*

*Commissioner of Patents and Trademarks*